United States Patent [19]

Schultz

[11] Patent Number: 4,604,765

[45] Date of Patent: Aug. 12, 1986

[54] ARTICLE RETAINING DEVICE

[76] Inventor: Dennis B. Schultz, 418 N. Van Buren, East Dundee, Ill. 60118

[21] Appl. No.: 606,469

[22] Filed: May 3, 1984

[51] Int. Cl.[4] ..... A47G 9/08; A45F 3/04; B65D 30/04

[52] U.S. Cl. ..... 5/413; 150/52 R; 224/153; 383/4

[58] Field of Search ..... 5/413, 420, 502; 2/69.5; 190/2; 150/52 R; 224/156, 153, 151; 383/4

[56] References Cited

U.S. PATENT DOCUMENTS

| | | | |
|---|---|---|---|
| 1,792,582 | 2/1931 | Goldsmith | 150/52 R |
| 2,352,794 | 7/1944 | Love | 150/52 R |
| 2,667,353 | 1/1954 | Lanice | 150/52 R |
| 2,674,288 | 4/1954 | Laidlaw | 150/52 R |
| 2,971,205 | 2/1961 | Schultz | 2/69.5 |
| 3,042,939 | 7/1962 | Schoellkopf et al. | 383/4 |
| 3,238,871 | 12/1980 | Cannon | 5/413 |
| 3,774,249 | 11/1973 | Ybarra et al. | 5/413 |
| 4,154,323 | 5/1979 | Sneider | 190/2 |
| 4,182,391 | 1/1980 | Kjose | 150/52 R |
| 4,501,362 | 2/1985 | Duncan | 190/2 |

FOREIGN PATENT DOCUMENTS

| | | | |
|---|---|---|---|
| 819449 | 10/1951 | Fed. Rep. of Germany | 5/417 |

*Primary Examiner*—Alexander Grosz
*Attorney, Agent, or Firm*—Powell L. Sprunger

[57] ABSTRACT

An article retaining device comprising, a sleeping bag having a pair of padded panels with one of the panels overlying the other panel. The panels have a first end portion, a second opposed end portion, and a central portion therebetween, with the panels being folded to a configuration of reduced length and having a pocket to receive articles for storage in the pocket. The device has a cover for the sleeping bag comprising, a pair of flexible sheets with one of the sheets overlying the other sheet, the sheets having a pair of opposed end edges and a pair of opposed side edges connecting the end edges. The sheets have an opening along at least one of the edges to receive the folded bag, and the sheets define a cavity sufficiently large to receive and cover the folded bag.

39 Claims, 15 Drawing Figures

FIG. 1
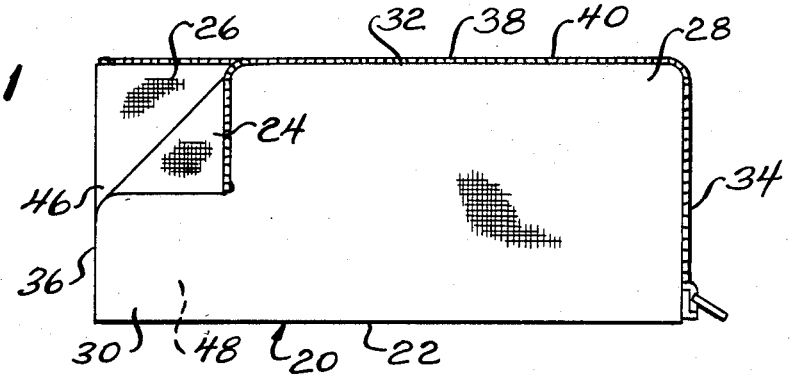
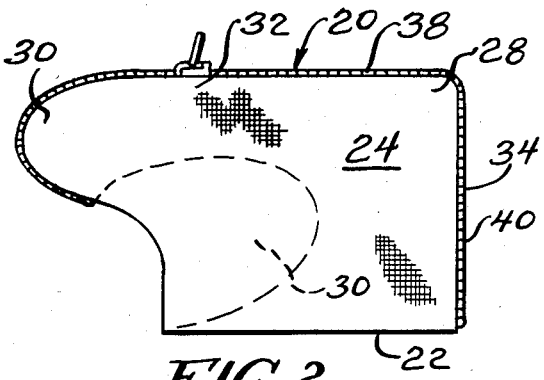
FIG 2
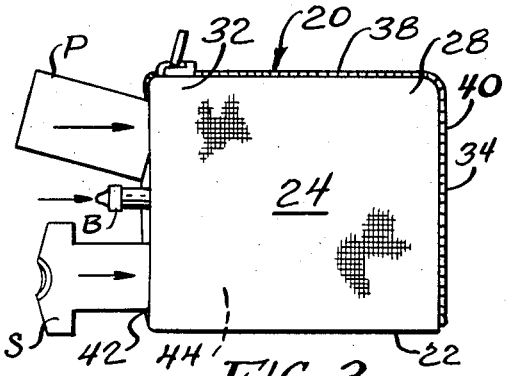
FIG. 3
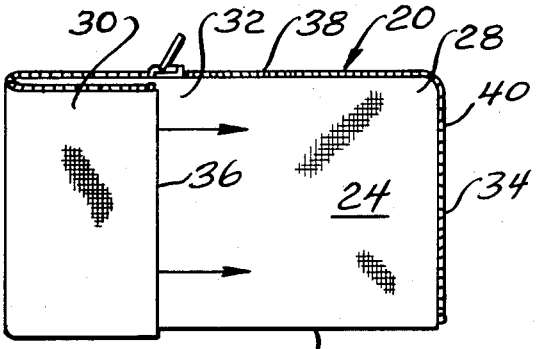
FIG. 4
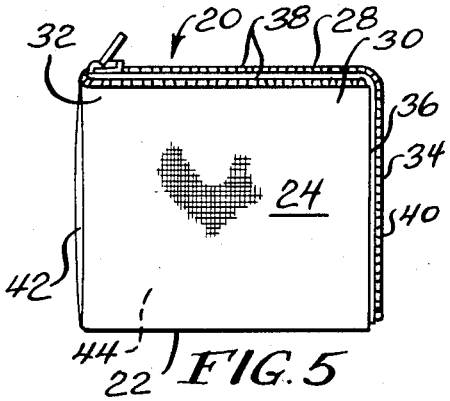
FIG. 5
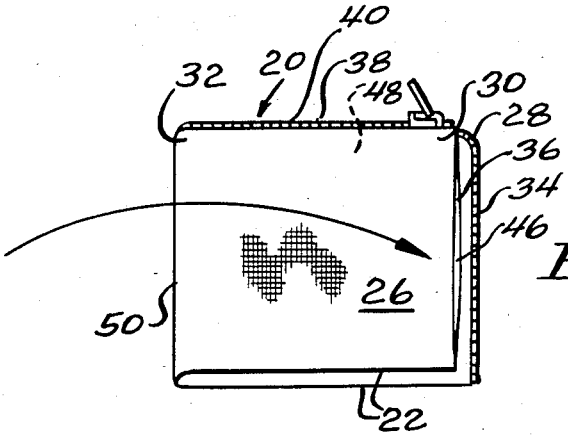
FIG. 6

ARTICLE RETAINING DEVICE

BACKGROUND OF THE INVENTION

The present invention relates to sleeping bags.

In the past, sleeping bags have been well known. Such sleeping bags normally comprise first and second padded panels, with one of the panels overlying the other of the panels. The bags have a zipper to close a lower edge and a side edge of the panels, and the panels are rolled up and tied in a suitable manner when not in use. Such sleeping bags are often used during hiking or camping, and during such times it is often necessary for the user to carry the bag and other articles, such as food, clothing or a pillow, which is frequently inconvenient and difficult.

SUMMARY OF THE INVENTION

A principal feature of the present invention is the provision of an article retaining device.

The article retaining device of the present invention comprises, a sleeping bag having a pair of padded panels with one of the panels overlying the other panel. The panels have a first end portion, a second opposed end portion, and a central portion therebetween. The panels are folded to a configuration of reduced length to define a pocket between the panels and an opening communicating with the pocket. The device has a cover for the sleeping bag comprising, a pair of flexible sheets with one of the sheets overlying the other sheet. The sheets have a pair of opposed end edges and a pair of opposed side edges connecting the end edges. The sheets have an opening along at least one of the edges, and the sheets define a cavity. The device has means for closing the cover opening.

A feature of the present invention is that various articles may be passed through the bag opening into the pocket for storage in the sleeping bag.

Yet another feature of the invention is that the sleeping bag is folded into a compact configuration.

Still another feature of the invention is that the sleeping bag may be passed through the cover opening into the cavity for storage therein.

A further feature of the invention is that the closing means may be closed in order to retain the sleeping bag in the cover.

Yet another feature of the invention is that the cover and retained bag may be folded about a central fold line in order to place the cover and bag into a compact configuration.

Still another feature of the invention is the provision of means for securing the cover in the compact configuration.

A feature of the present invention is the provision of means for carrying the device.

Further features will become more fully apparent in the following description of the embodiments of this invention and from the appended claims.

DESCRIPTION OF THE DRAWINGS

In the drawings:

FIG. 1 is a front plan view of a sleeping bag;

FIGS. 2 and 3 are front plan views illustrating the bag of FIG. 1 being inverted and tucked into a compact configuration;

FIGS. 4 and 5 are front plan views of the sleeping bag of FIG. 1 being folded outwardly into a compact configuration;

FIG. 6 is a front plan view of the sleeping bag of FIG. 1 being folded along a lateral central fold line;

DESCRIPTION OF THE PREFERRED EMBODIMENTS

Figure 7:
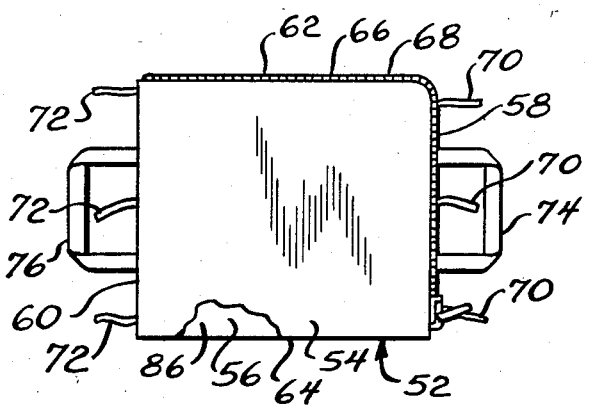
FIG. 7 is a front plan view of a cover for the folded sleeping bag of FIGS. 1–6.

Referring now to FIG. 1, there is shown a sleeping bag generally designated 20 having a longitudinally extending first fold line 22 defining a pair of padded panels 24 and 26, with the panel 24 overlying the panel 26. The panels 24 and 26 have a lower first end portion 28, an upper second end portion 30, and a central portion 32 intermediate the lower end portion 28 and upper end portion 30. The panels 24 and 26 have opposed first and second end edges 34 and 36, and a side edge 38 extending between the end edges 34 and 36, with the fold line 22 also extending between the end edges 34 and 36. The bag 20 has a zipper 40 extending along the first end edge 34 and the side edge 38 such that these edges may be opened or closed by the zipper 40. The panels 24 and 26 may be padded in any suitable manner, such as by down.

With reference to FIGS. 2 and 3, the zipper 40 is closed to the central portion 32 of the panels 24 and 26, and the upper portion 30 of the panels 24 and 26 is inverted and tucked between an adjoining portion of the panels 24 and 26 until an opening 42 is defined in the central portion 32 of the panels 24 and 26, with the opening 42 communicating with a pocket 44 between the panels 24 and 26. Thus, the sleeping bag is folded into a compact configuration, and various articles, such as a pillow P, a baby bottle B, or a shirt S may be passed through the opening 42 into the pocket 44 for storage therein.

Another embodiment of the folded sleeping bag 20 is illustrated in FIGS. 4 and 5, in which like reference numerals designate like parts. The zipper 40 is closed to the central portion 32, and, with reference to FIG. 4, the upper portion 30 of the panels 24 and 26 is folded over an outer surface of the panels 24 and 26 until the upper portion 30 is located adjacent the lower portion 28 of the panels 24 and 26, with the end edges 34 and 36 being generally aligned, such that the folded panels 24 and 26 define an opening 42 in the central portion 32 communicating with a pocket 44 between the panels 24 and 26. Thus, in FIGS. 4 and 5 the sleeping bag 20 is folded into a compact configuration, and the various articles may be passed through the opening 42 into the pocket 44 for storage therein.

Another embodiment of the folded sleeping bag 20 is illustrated in FIG. 6, in which like reference numerals designate like parts. In this embodiment, the sleeping bag of FIG. 1 has the zipper 40 closed to the second end edge 36, and the various articles may be passed through an opening 46 at the end edge 36 into a pocket 48 defined between the panels 24 and 26 for retention of the articles between the panels 24 and 26. Next, the bag 20 of FIG. 1 is folded along a lateral central second fold line 50 such that the upper end portion 30 is located adjacent the lower end portion 28, with the edges 34 and 36 being generally aligned. Thus, the sleeping bag 20 is folded into a compact configuration with the articles being stored intermediate the panels 24 and 26 of the bag 20.

Figure 8:
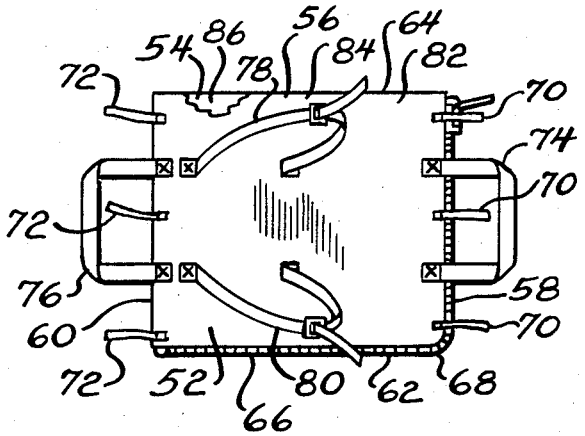
FIG. 8 is a back plan view of the cover of FIG. 7.

A cover 52 for the folded sleeping bag is illustrated in FIGS. 7 and 8. The cover 52 has first and second sheets 54 and 56 of flexible material with one of the sheets 54 overlying the other sheet 56. The sheets 54 and 56 are preferably constructed of a water impervious material, such as a suitable plastic, and is preferably reinforced by a suitable scrim for durability of the sheets 54 and 56. The sheets 54 and 56 have opposed first and second end edges 58 and 60, and opposed first and second side edges 62 and 64 connecting the end edges 58 and 60. The sheets 54 and 56 are connected by fold lines along the end edge 60 and the side edge 64, and the sheets 54 and 56 have an opening 66 extending along the end edge 58 and the side edge 62, with the opening 66 being closed by a second zipper 68.

The sheets 54 and 56 have a plurality of ties 70 located adjacent the end edge 58, and a plurality of ties 72 adjacent the end edge 60, with the ties 70 being aligned with the ties 72 for a purpose which will be described below. The sheets 54 and 56 have a first strap 74 secured to spaced portions adjacent the end edge 58, and a second strap 76 secured to spaced portions adjacent the end edge 60. The cover 52 has third and fourth straps 78 and 80 secured to spaced portions on an outer surface 82 of the cover 52, with the straps 78 and 80 being secured adjacent the end edge 60 and a central portion 84 of the cover 52. As shown, the length of the straps 78 and 80 is adjustable by suitable means known to the art.

Figure 9:
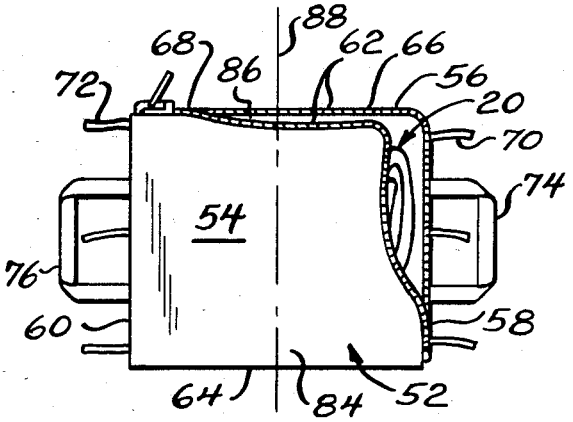
FIG. 9 is a front perspective view illustrating the cover of FIGS. 7 and 8 as receiving the folded sleeping bag.
Figure 10:
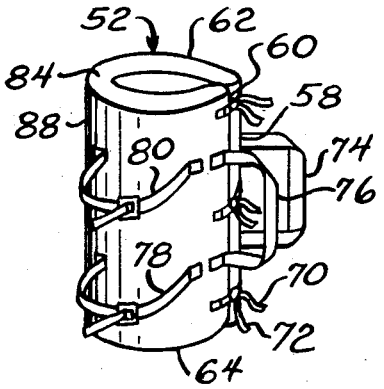
FIG. 10 is a perspective view illustrating the cover of FIG. 9 being folded into a compact configuration.
Figure 11:
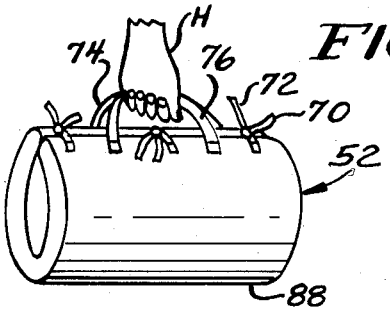
FIG. 11 is a perspective view illustrating the cover and bag of FIG. 10 as being carried by a user's hand.
Figure 12:
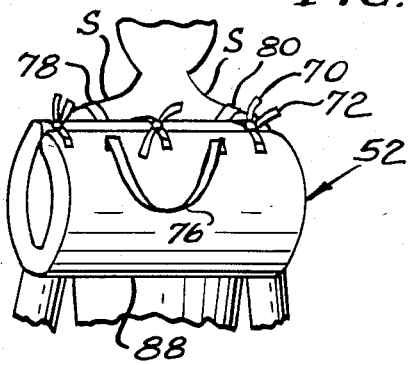
FIG. 12 is a perspective view of the cover and bag of FIG. 10 as being received on a user's shoulder.

With reference to FIG. 9, the zipper 68 is unzipped in order to form the opening 66 extending along the end edge 58 and side edge 62, after which the folded sleeping bags of FIGS. 3, 5, and 6 may be inserted through the opening 66 into a cavity 86 between the sheets 54 and 56. Next, the zipper 68 may be closed along the side edge 62 and end edge 58 in order to retain the folded sleeping bag 20 in the cavity 86 with the articles being retained in the folded sleeping bag. With reference to FIGS. 9 and 10, the closed cover 52 may then be folded along a lateral central third fold line 88 in order to place the end edges 60 and 58 adjacent each other after which the ties 70 and 72 are tied to each other in order to secure the end edges 58 and 60 together and form the cover 52 and bag 20 into a compact configuration. In this configuration, with reference to FIG. 11, the straps 74 and 76 may be grasped by a user's hand H in order to carry the cover 52 and stored bag 20. Alternatively, with reference to FIG. 12, the straps 78 and 80 may be received on a user's shoulders S in order to carry the folded cover 52 and bag 20 with the articles stored therein.

Thus, in accordance with the present invention, a sleeping bag 10 and cover 52 are disclosed in which various articles may be stored and carried in a convenient manner. Suitable uses of the sleeping bag 10 of the present invention will be described as follows. For campers and hikers, the bag 10 may be utilized for sleeping, and as a back pack in order to retain and carry suitable articles. For children, the sleeping bag may be utilized as an overnight bag and to carry articles for slumber parties. For college students, the sleeping bag may be utilized to sleep during traveling and in order to carry articles during the traveling period. For the military, the sleeping bag may be utilized to sleep in the bag and is a back pack in order to carry suitable articles. For families, the sleeping bag 10 may be utilized as a travel bag in order to sleep and as a back pack in order to retain and carry suitable articles. For mothers and infants, the sleeping bag 10 may be utilized in order to sleep and to store infant care articles, such as diapers and feeding supplies.

Figure 13:
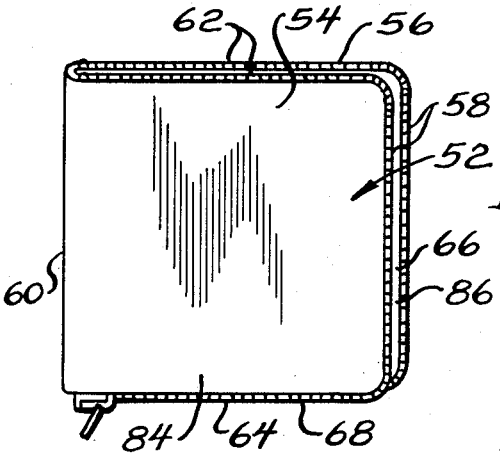
FIG. 13 is a front plan view of another embodiment of the cover for the sleeping bag.

Another embodiment of the cover 52 is illustrated in FIG. 13, in which like reference numerals designate like parts. In this embodiment, the opening 66 extends along three edges, such as the side edge 64, the end edge 58, and the side edge 62. Also, the zipper 68 extends along the side edge 64, the end edge 58, and the side edge 62, with the end edge 60 being defined by a fold line of the sheets 54 and 56.

In use, the zipper 68 is unzipped in order to expose the opening 66, and the folded sleeping bags of FIGS. 3, 5, or 6 may be inserted through the opening 66 into a cavity 86 between the sheets 54 and 56, after which the zipper 68 is closed in order to retain the folded sleeping bag and articles between the sheets 54 and 56. The cover 52 of FIG. 13 may have the ties 70 and 72, and the straps 74, 76, 78, and 80 previously described in connection with FIGS. 7 and 8 located adjacent similar portions of the cover 52, such that the cover 52 of FIG. 13 may be folded along a lateral central fold line and may be secured in the folded configuration by the ties, and may be carried by the straps 74 and 76 or by the straps 78 and 80. When it is desired to utilize the sleeping bag, the zipper 68 is unzipped along the three edges, and the sleeping bag is removed from the cover 52. After removal of the bag from the cover 52 of FIG. 13, the articles which are stored in the sleeping bag 20 may be removed from the sleeping bag, and may be placed in the cavity 86 of the cover 52, after which the zipper 68 is closed in order to retain the articles in the cover 52 while utilizing the sleeping bag such as overnight.

Figure 14:
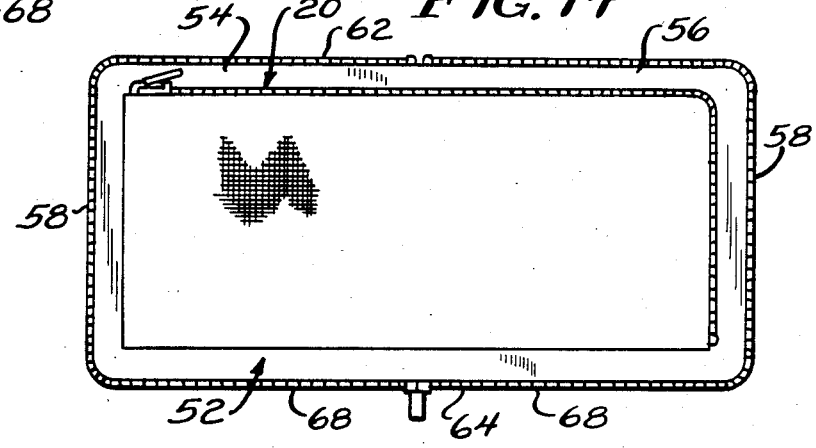
FIG. 14 is a front plan view illustrating the cover of FIG. 13 as being unfolded to support the sleeping bag of FIG. 1.

In an alternative form, with reference to FIG. 14, the zipper 68 of the cover 52 may be unzipped along the three edges, and the cover 52 may be placed on the ground in the unfolded configuration, after which the unfolded sleeping bag 20 may be placed on the cover 52. In this form, the sleeping bag 20 may be utilized for sleeping, such as overnight, and the cover 52 protects the sleeping bag 20 from moisture during use of the sleeping bag 20 since the cover 52 is constructed from a water impervious material.

Figure 15:
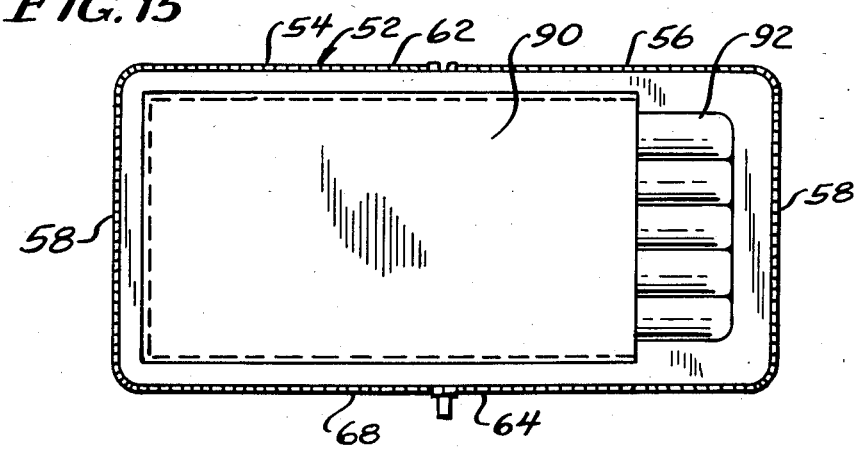
FIG. 15 is an embodiment of the cover of FIG. 13 which is adapted to receive an air mattress.

In an alternative form, with reference to FIG. 15, the unzipped cover 52 of FIG. 13 may have an elongated pocket 90 extending along the cover 52 in order to receive an inflated air mattress 92 in the pocket 90. Thus, the water impervious cover 52 retains the mattress 92 by the pocket 90, and the sleeping bag 20 may be placed over the inflated air mattress 92 while the cover 52 prevents movement of the air mattress 92.

The foregoing detailed description is given for clearness of understanding only, and no unnecessary limitations should be understood therefrom, as modifications will be obvious to those skilled in the art.

I claim:

1. An article retaining device, comprising:

a sleeping bag comprising, a pair of padded panels with one of the panels overlying the other panel, said panels having a first end portion, a second opposed end portion, and a central portion therebetween, said panels being folded to a configuration of reduced length to define a pocket between the panels and such that the central portion defines an opening communicating with the pocket to receive articles for storage in the pocket;

a cover for the sleeping bag comprising, a pair of flexible sheets with one of the sheets overlying the other sheet, said sheets having a pair of opposed end edges and a pair of opposed side edges connecting the end edges, said sheets having an opening along at least one of the edges to receive the folded bag, and said sheets defining a cavity sufficiently large to receive and cover the folded bag;

means for closing the cover opening, the bag and cover being folded along a central fold line such that opposed edges of the cover are generally aligned with each other; and means for securing said aligned edges together.

2. The device of claim 1 wherein the closing means comprises a zipper.

3. The device of claim 1 wherein the cover opening extends along a pair of adjacent edges.

4. The device of claim 3 wherein the cover opening extends along one side edge and an end edge.

5. The device of claim 1 wherein the cover opening extends along three adjacent edges.

6. The device of claim 5 wherein the cover opening extends along both side edges and one end edge therebetween.

7. The device of claim 5 wherein the cover includes an elongated pocket on a surface of the sheets to receive an air mattress.

8. The device of claim 1 wherein the second end portion of said panel is inverted and tucked between an adjoining portion of said panels to define the pocket and bag opening.

9. The device of claim 8 wherein the bag opening is located in the central portion of the panels.

10. The device of claim 1 wherein the second end portion of said panels is folded over an adjoining portion of said panels to define the pocket and bag opening.

11. The device of claim 10 wherein the bag opening is located in the central portion of the panels.

12. The device of claim 1 wherein the securing means comprises a plurality of ties adjacent said aligned edges.

13. The device of claim 1 including means for carrying the device.

14. The device of claim 13 wherein the carrying means comprises a pair of straps secured adjacent the aligned edges.

15. The device of claim 13 wherein the carrying means comprises a pair of spaced straps located on an outer surface of the cover to receive the shoulders.

16. The device of claim 11 wherein the cover and bag are folded along a lateral central fold line.

17. The device of claim 1 wherein the panels have a pair of opposed end edges, a pair of opposed side edges connecting the end edges, and means for closing one end edge and an adjacent side edge.

18. The device of claim 17 wherein the closing means is closed to said central portion of the panels.

19. The device of claim 17 wherein the bag closing means comprises a zipper.

20. An article retaining device, comprising:

a sleeping bag comprising, a pair of padded panels with one of the panels overlying the other panel, said panels having a first end portion, a second opposed end portion, and a central portion therebetween, said panels defining a pocket between the panels and an opening in one end portion communicating with the pocket to receive articles for storage in the pocket, said panels being folded along a lateral central fold line such that the first and second end portions are located adjacent each other;

a cover for the sleeping bag comprising, a pair of flexible sheets with one of the sheets overlying the other sheet, said sheets having a pair of opposed end edges and a pair of opposed side edges connecting the end edges, said sheets having an opening along at least one of the edges to receive the folded bag, and said sheets defining a cavity sufficiently large to receive and cover the folded bag;

means for closing the cover opening, the bag and cover being folded along a central fold line such that opposed edges of the cover are generally aligned with each other; and means for securing said aligned edges together.

21. The device of claim 20 wherein the closing means comprises a zipper.

22. The device of claim 20 wherein the cover opening extends along a pair of adjacent edges.

23. The device of claim 22 wherein the cover opening extends along one side edge and an end edge.

24. The device of claim 20 wherein the cover opening extends along three adjacent edges.

25. The device of claim 24 wherein the cover opening extends along both side edges and an end edge therebetween.

26. The device of claim 24 wherein the cover includes an elongated pocket on a surface of the sheets to receive an air mattress.

27. The device of claim 20 wherein the securing means comprises a plurality of ties adjacent said aligned edges.

28. The device of claim 20 inlcuding means for carrying the device.

29. The device of claim 28 wherein the carrying means comprises a pair of straps secured adjacent the aligned edges.

30. The device of claim 28 wherein the carrying means comprises a pair of spaced straps located on an outer surface of the cover to receive the shoulders.

31. The device of claim 20 wherein the cover and bag are folded along a lateral central fold line.

32. The device of claim 20 wherein the panels have a pair of opposed end edges, a pair of opposed side edges connecting the end edges, and means for closing one end edge and an adjacent side edge.

33. The device of claim 32 wherein the closing means is closed to said second end portion of the panels.

34. The device of claim 32 wherein the bag closing means comprises a zipper.

35. A cover for a folded sleeping bag, comprising:

a pair of flexible outer sheets with one of the sheets overlying the other sheet, said sheets having a pair of opposed end edges and a pair of opposed side edges connecting the end edges, said sheets having an opening along at least one of the edges to receive the folded bag, and said sheets defining a cavity sufficiently large to receive and cover the bag, said overlying outer sheets of the cover being folded only along a central fold line such that opposed edges are generally aligned with each other;

means for closing the opening prior to folding of the overlying outer sheets of the cover along the central fold line comprising a zipper extending along the opening; and means for securing the aligned edges together.

36. The cover of claim 35 wherein the securing means comprises a plurality of ties adjacent the aligned edges.

37. A cover for a folded sleeping bag, comprising:

a pair of flexible outer sheets with one of the sheets overlying the other sheet, said sheets having a pair of opposed end edges and a pair of opposed side edges connecting the end edges, said sheets having an opening along at least one of the edges to receive the folded bag, and said sheets defining a cavity sufficiently large to receive and cover the bag, said overlying outer sheets of the cover being folded only along a central fold line such that opposed edges are generally aligned with each other;

means for closing the opening;

strap means for carrying the device and means for securing the aligned edges together.

38. The cover of claim 37 wherein the carrying means comprises a pair of straps located adjacent the aligned edges.

39. The cover of claim 37 wherein the carrying means comprises a pair of spaced straps located on an outer surface of the cover to receive the user's shoulders.

* * * * *